United States Patent [19]

Woringer

[11] 4,094,469

[45] June 13, 1978

[54] FUEL INJECTION NOZZLE ASSEMBLY

[75] Inventor: Theo Woringer, Zurich, Switzerland

[73] Assignee: BBC Brown, Boveri & Company Limited, Baden, Switzerland

[21] Appl. No.: 744,781

[22] Filed: Nov. 24, 1976

[30] Foreign Application Priority Data

Dec. 12, 1975 Switzerland ..... 16139/75

[51] Int. Cl.[2] ..... B05B 7/10

[52] U.S. Cl. ..... 239/405; 239/399

[58] Field of Search ..... 239/399, 401, 403, 405, 239/406, 408

[56] References Cited

U.S. PATENT DOCUMENTS

| | | | |
|---|---|---|---|
| 1,559,759 | 11/1925 | Müller | 239/408 |
| 4,006,719 | 2/1977 | Kanda et al. | 239/403 |

FOREIGN PATENT DOCUMENTS

| | | | |
|---|---|---|---|
| 489,632 | 7/1938 | United Kingdom | 239/406 |

*Primary Examiner*—Robert W. Saifer

*Attorney, Agent, or Firm*—Toren, McGeady and Stanger

[57] ABSTRACT

A fuel-injection nozzle assembly particularly useful for gas turbines is provided with an additive supply arrangement which avoids mixture of the fuel additive with the fuel in the nozzle until the fuel reaches a swirl chamber within the nozzle. The nozzle includes a nozzle holder, a nozzle plunger extending generally centrally of the holder and fuel inlet passages which are defined between the holder and the plunger. The nozzle exhaust opening is located centrally of the plunger and the swirl chamber is defined to extend between the end of the nozzle plunger and the nozzle exhaust opening. The additive supply arrangement directs the additive through the nozzle to a discharge point within or adjacent the swirl chamber. The additive supply arrangement of the invention may consist of a supply conduit extending centrally of the nozzle plunger, supply conduits extending directly through the fuel inlet passages or supply conduits extending either externally of the nozzle walls or internally through the walls themselves.

2 Claims, 4 Drawing Figures

FUEL INJECTION NOZZLE ASSEMBLY

BACKGROUND OF THE INVENTION

The present invention relates to fuel injection nozzles generally and more particularly to internal combustion engine fuel injection nozzles particularly useful with gas turbines. The nozzle assembly of the type to which the present invention relates includes a nozzle holder, a nozzle plunger and fuel-inlets with tangential ports, with the assembly being constructed to define a swirl chamber for the fuel within the nozzle assembly.

In known fuel-injection nozzles, there is provided a swirl chamber into which the fuel passes through tangential holes or slots. The fuel is formed in the swirl chamber into a vortex flow pattern having a generally fuel-free central or middle portion. The stream of fuel thus formed emerges from the nozzle in a form of hollow conical flow pattern.

When the fuels which are ordinarily used in operating gas turbines are utilized, it may occur that such fuels will contain corrosive constituents which could have a detrimental effect upon the turbine blades and the material of ducts through which hot gas is passed. For this reason, additives are normally mixed with the fuel in order to protect the components of the turbine. The additives are normally added to the fuel in the tank where the fuel is stored or, alternatively, additives may be mixed with the fuel during its flow through the fuel line which directs the fuel into the atomizing nozzle.

It has been found that certain additives are not compatible with foreign substances present in the fuel, an example of such substances being water. Since precipitation and deposits will occur in the fuel system, such precipitation or deposits may lead to blockages especially in components where relative sliding movements between closely fitting parts may occur, such as for example in valves, the fuel nozzle, control elements or the like.

Accordingly, it is an object to the present invention to provide a fuel-injection nozzle assembly which will permit the addition of appropriate fuel additives which may be fed to the fuel at a point where deposits of harmful substances will be avoided.

The principle aim of the present invention is to provide an assembly wherein the means supplying the fuel additives to the nozzle assembly are so arranged that the fuel supply and the additive supply are maintained separate from each other until a point at which the additive supply is introduced into the fuel flow at or near the swirl chamber of the nozzle assembly.

SUMMARY OF THE INVENTION

Briefly, the present invention may be described as a fuel-injection nozzle assembly which is particularly useful in gas turbines, comprising a nozzle holder, a nozzle plunger extending generally centrally of the holder, fuel inlet passage means defined between the holder and the plunger, means defining a nozzle exhaust opening and means defining a swirl chamber. The nozzle plunger has an end which terminates adjacent the nozzle exhaust opening. The swirl chamber is defined to extend to between the plunger and the nozzle exhaust opening and additive supply means are provided for introducing a fuel-additive into the nozzle assmbly. The additive supply means are arranged to maintain the flow of the additives therethrough separate from the fuel flow until the swirl chamber where the additive supply means terminate and deposit the additive flow into the fuel flow.

With the arrangement according to the present invention it becomes possible to feed appropriate quantities of additives to the fuel flow just as the fuel leaves the nozzle. The injected quantity of additives may, for example, be approximately 0.1% of the injected quantity of fuel. The additives will then no longer be mixed with the fuel in the storage tank and no deposits or precipitation will occur in the fuel system.

In one embodiment of the present invention the fuel additive means are formed as a fuel duct which is arranged to extend through the interior of the nozzle plunger. With a configuration of this type it is possible to introduce the additives directly into the swirl chamber through the duct provided in the nozzle plunger and to arrange the outlet ports so that an intimate swirling effect is achieved with fuel entering the swirl chamber from the tangential ports of the nozzle assembly.

In another alternative embodiment of the invention, the additive supply means may be formed as additive supply pipes which extend directly through the flow channel through which the fuel flows with the pipes terminating adjacent the swirl chamber.

By a further embodiment, the additive supply means are formed as ducts which extend through the walls of the nozzle holder itself and in a still further embodiment the additive supply lines may extend externally of the nozzle holder.

In applications of the present invention where space is a problem and insufficient space is available in the vicinity of the injection nozzle, the first three embodiments mentioned above are preferred. Where gas turbine installations are involved having sufficient space in the vicinity of the injection nozzle, it is recommended that the additive supply lines be located upon the outer wall of the nozzle holder in accordance with the fourth embodiment of the invention described above.

In any case, regardless of which of the aforementioned embodiments are utilized, it is intended that the additive supply lines or ducts should be arranged so that they terminate at or in the vicinity of the tangential ports of the fuel nozzle so that the additives shall be introduced into the swirl chamber adjacent the tangential ports.

With the arrangement in accordance with the present invention, additives passing by way of the separate additive supply system are mixed with the fuel at the atomizer nozzle, i.e. immediately before the fuel is atomized in the combustion chamber, and in such a way that leaks or backflow are located upstream from the mixing point but such that the additive is intimately mixed with the fuel and at the same time atomized.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
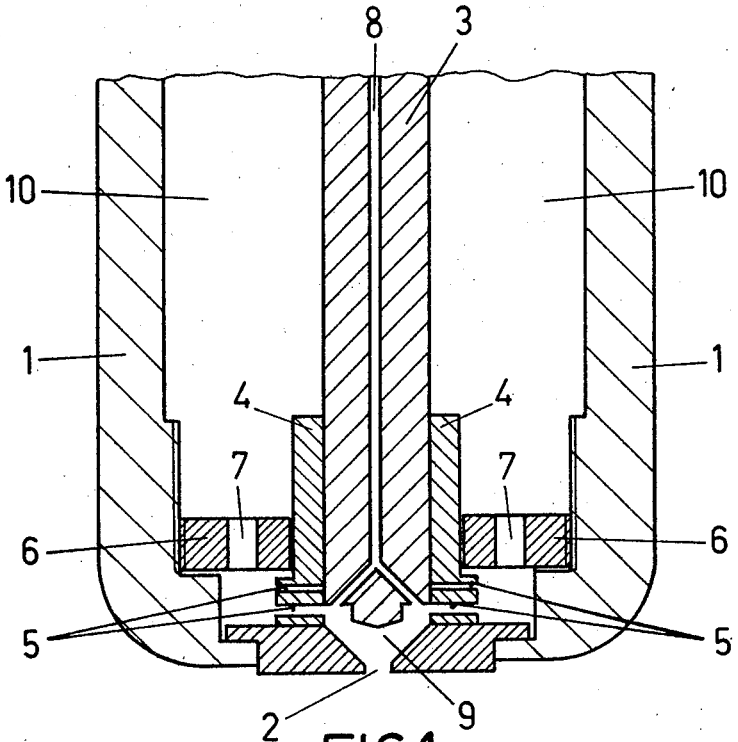
FIG. 1 is a sectional view taken through a fuel-injection nozzle assembly in accordance with the present invention wherein the additive supply means are arranged in the form of an additive supply duct located to extend within or through the nozzle plunger.

Referring now to the drawings, wherein like reference numerals refer to similar parts throughout the various figures thereof, the first embodiment of the invention is shown in FIG. 1 and comprises a fuel-injection nozzle assembly including a nozzle holder 1 which has at its lower end means defining a nozzle opening 2 which is bounded in the upper direction by the lower end of a nozzle plunger 3. The nozzle plunger 3 is held within the nozzle holder 1 by a tangential jet sleeve 4 which incorporates tangential ports 5 towards the nozzle opening 2. Between the nozzle holder 1 and the tangential jet sleeve 4 there is arranged a threaded retaining collar 6 having holes or orifices 7 to allow passage of fuel therethrough.

Extending axially through the nozzle plunger 3 there is provided, in this first embodiment of the invention, additive supply means in the form of an additive supply duct 8 which terminates within a swirl chamber 9 defined at the lower end of the plunger 3 between the plunger end and the means defining the nozzle opening 2.

In the fuel injection nozzle assembly described above, the fuel is passed by way of a fuel inlet through the fuel inlet passages 10, with the fuel then passing through the holes 7 in the threaded collar 6 and through the tangential ports 5. The fuel thus passes through the swirl chamber 9 at which point it will come into contact with the additives which are fed through the additive supply duct 8 in the nozzle plunger 3. The fuel and the additives will be rotated in the swirl chamber 9 and then pass through the nozzle opening 2 into the combustion chamber in a turbulent, finely dispersed state.

Figure 2:
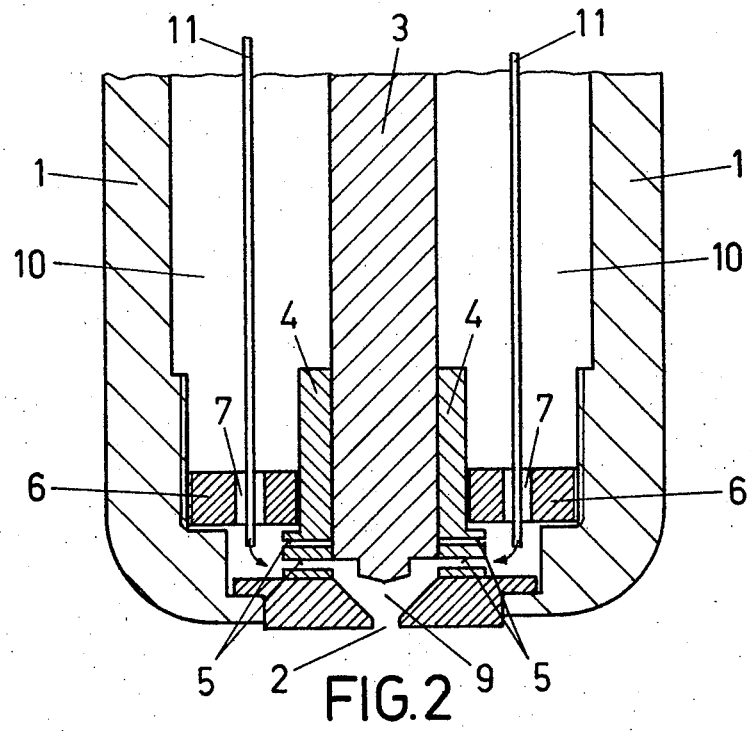
FIG. 2 is a sectional view of another embodiment of the invention wherein the additive supply means are formed as additive supply lines extending through the fuel inlet passages of the nozzle assembly.

In the second embodiment of the present invention depicted in FIG. 2, instead of the additive supply means extending in the manner of the duct 8 directly through the center of the nozzle plunger 2, as shown and described in FIG. 1, additional additive supply lines 11 are provided within the fuel inlet supply passage 10, with these lines extending through the holes 7 in the threaded collar 6 and terminating in front of the tangential ports in the tangential jet sleeve 4. Here, the fuel which is fed via the fuel inlet 10 is mixed with the additive and is made turbulent only after passing into the swirl chamber 9.

Figure 3:
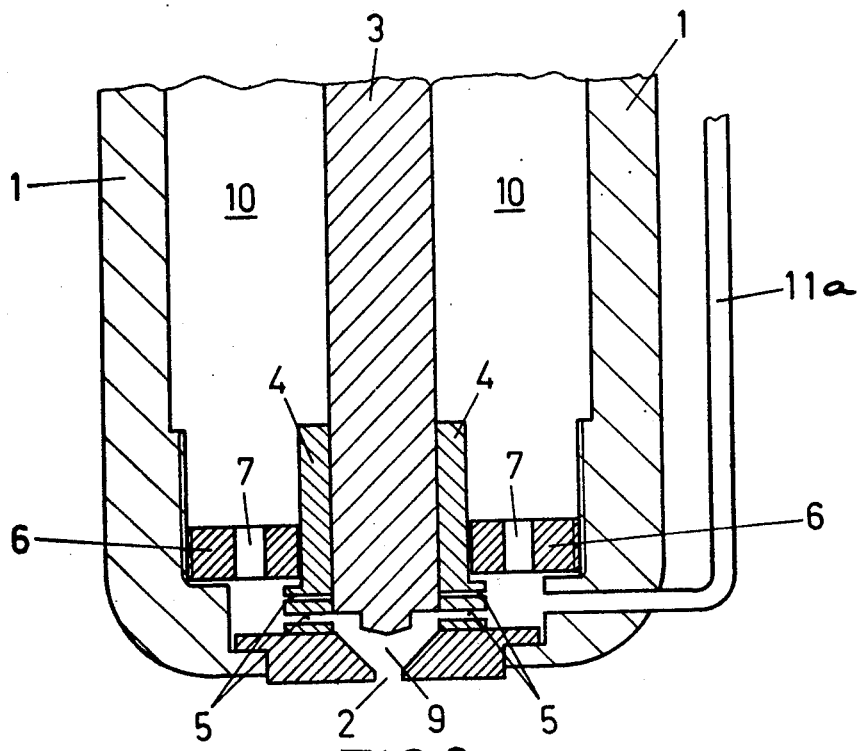
FIG. 3. is a sectional view showing a further embodiment of the invention wherein the additive supply means are arranged as an additive supply line located upon the outer wall of the nozzle holder.

In the alternative form of the invention involved with the embodiment shown in FIG. 3, the additive supply means is composed of an additive supply line 11*a* which is located upon the outer wall of the nozzle holder 1 and similarly terminates in the space between the holes 7 in ghe threaded collar 6 and tangential ports 5 in the tangential jet sleeve 4, where the additive is mixed with the fuel coming through the fuel inlet 10 and is passed through the swirl chamber 9 through the tangential ports 5.

Figure 4:
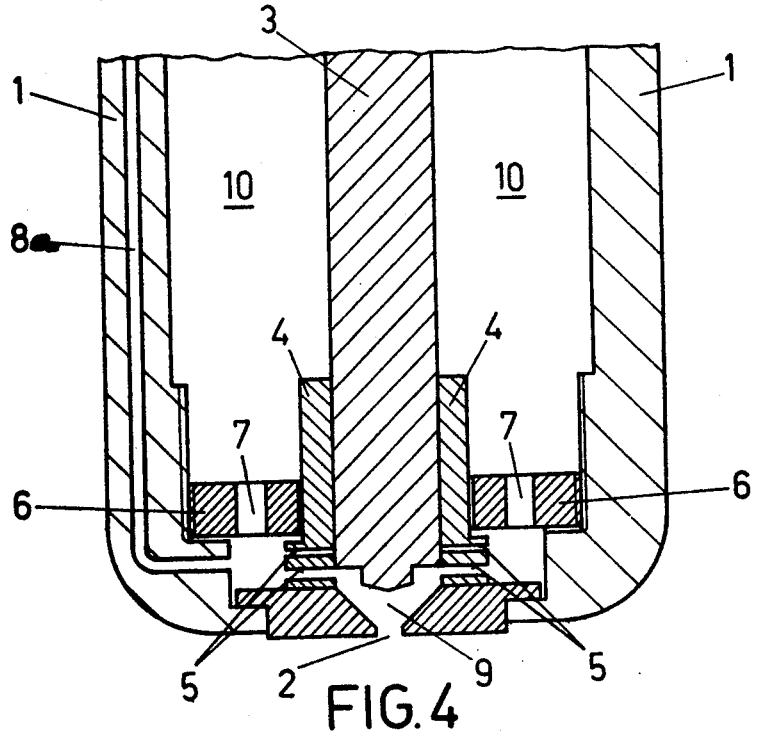
FIG. 4 is a sectional view showing a further embodiment of the invention wherein the additive supply means comprise a supply duct located within the wall of the nozzle holder itself.

In the case of gas turbines where, for reasons of design, there is little space available, the embodiment of FIG. 4 is to be recommended. In this alternative form of the invention, the additive supply means is composed of an additive supply duct 8*a* which passes directly through the wall of the nozzle holder 1 and which again terminates after the holes 7 so that here the additives are mixed with the fuel fed through the fuel inlet 10 and the holes 7 in the threaded collar 6 and passed together with the fuel through the tangential ports 5 into the swirl chamber 9, where intimate swirling takes place before the fuel/additive mixture emerges through the nozzle opening 2 into the combustion chamber.

In describing the present invention, it should be understood that features which are not necessary to an immediate understanding of the important elements of the invention have been omitted from the figures of the drawings in order to enhance the clarity of the description. Thus, items such as the means of regulating the fuel flow, the screw fitting of the fuel-injection nozzle and the fuel supply lines outside of the nozzle holder 1 are not depicted in the drawings since they are not deemed necessary to complete understanding of the invention.

While specific embodiments of the invention have been shown and described in detail to illustrate the application of the inventive principles, it will be understood that the invention may be embodied otherwise without departing from such principles.

What is claimed is:

1. A fuel injection nozzle assembly particularly for gas turbines comprising a nozzle holder, a nozzle plunger extending generally centrally of said holder, fuel inlet passage means defined between said holder and said plunger, means defining a nozzle exhaust opening, said nozzle plunger having an end terminating adjacent said nozzle exhaust opening, means defining a swirl chamber extending to between said plunger end and said nozzle opening, tangential port means through which fuel flows between said fuel inlet passage means and said swirl chamber, and additive supply means for introducing a fuel additive into said nozzle assembly, said additive supply means comprising an additive inlet duct provided in said nozzle plunger and being arranged to maintain the flow of additives through said nozzle assembly separate from the fuel flowing therein and to deposit said additives directly in said swirl chamber.

2. A fuel injection nozzle assembly particularly for gas turbines comprising a nozzle holder, a nozzle plunger extending generally centrally of said holder, fuel inlet passage means defined between said holder and said plunger, means defining a nozzle exhaust opening, said nozzle plunger having an end terminating adjacent said nozzle exhaust opening, means defining a swirl chamber extending to between said plunger end and said nozzle opening, tangential port means through which fuel flows between said nozzle inlet passage means and said swirl chamber, and additive supply means for introducing a fuel additive into said nozzle assembly, said additive supply means comprising additive supply lines provided to extend within said fuel inlet passage means, and being arranged to maintain the flow of additives through said nozzle assembly separate from the fuel flowing therein and to deposit said additives into said fuel at least in close proximity to said swirl chamber.

* * * * *